US012372341B1

(12) United States Patent
Matthews et al.

(10) Patent No.: US 12,372,341 B1
(45) Date of Patent: Jul. 29, 2025

(54) SYSTEM AND METHOD FOR UNDERWATER SHOCK GENERATION

(71) Applicant: United States of America as represented by the Secretary of the Navy, Arlington, VA (US)

(72) Inventors: Cameron Matthews, Panama City, FL (US); Brian E Wallace, Panama City, FL (US); April M Hirsch, Panama City, FL (US); Drew T Lucas, Panama City, FL (US); Keven A Dunn, Panama City, FL (US); Connor McCoy-Mickelson, Panama City, FL (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 18/428,145

(22) Filed: Jan. 31, 2024

(51) Int. Cl.

| | |
|---|---|
| ***F42D 1/04*** | (2006.01) |
| ***C25B 1/044*** | (2021.01) |
| ***C25B 9/015*** | (2021.01) |
| ***C25B 15/08*** | (2006.01) |
| ***F42D 3/00*** | (2006.01) |

(52) U.S. Cl.
CPC ..... *F42D 1/04* (2013.01); *C25B 1/044* (2021.01); *C25B 9/015* (2021.01); *C25B 15/081* (2021.01); *F42D 3/00* (2013.01)

(58) Field of Classification Search
CPC ... F42D 1/04; F42D 1/045; F42D 3/00; C25B 1/044; C25B 9/015; C25B 15/081; F42B 3/003; F42B 19/00; F42B 21/00; F42B 22/00
USPC ..... 102/325, 382, 390, 391, 392
See application file for complete search history.

(56) References Cited

U.S. PATENT DOCUMENTS 2,728,296 A * 12/1955 Meister ..... F42C 15/40 102/500

FOREIGN PATENT DOCUMENTS

CN 113841530 A * 12/2021
DE 4235018 A1 * 4/1994 ..... A01K 79/02

* cited by examiner

*Primary Examiner* — Bret Hayes
(74) *Attorney, Agent, or Firm* — James M. Kasischke; Jeffry C. Severson

(57) ABSTRACT

An underwater shock generation system and method uses an electrolysis generator supplied with an electrolytic liquid to generate an ignitable gas. A housing stores the ignitable gas and is adapted to be disposed in a water environment. An igniter is provided and is operable to ignite the ignitable gas stored in the housing to generate an explosion in the underwater environment. The housing is shaped to control a direction of propagation of the explosion in the water environment.

18 Claims, 6 Drawing Sheets

SYSTEM AND METHOD FOR UNDERWATER SHOCK GENERATION

ORIGIN OF THE INVENTION

The invention described herein was made in the performance of official duties by employees of the Department of Navy and may be manufactured, used, and licensed by or for the Government of the United States of America for Governmental purposes without payment of any royalties. This invention is owned by the United States Government and is available for licensing for commercial purposes. Licensing and technical inquiries may be directed to the Technology Transfer Office, Naval Surface Warfare Center Panama City Division, Panama City, Florida.

FIELD OF THE INVENTION

The invention relates generally to underwater acoustic systems, and more particularly to systems and methods for acoustically generating an underwater mechanical shock.

BACKGROUND OF THE INVENTION

The handling and transportation of munitions are generally sensitive operations requiring well-orchestrated safety constraints, systems, and methods implemented by skilled personnel. Unfortunately, accidents and system failures still occur that can have catastrophic consequences. In addition, undetonated munitions such as those found in underwater environments can remain hazardous to unsuspecting groups (e.g., divers, ship operators, fisherman, etc.) for decades.

SUMMARY OF THE INVENTION

Accordingly, it is an object of the present invention to provide systems and methods yielding insensitive munitions that may be safely handled and transported.

Another object of the present invention is to provide underwater munitions systems and methods that remain insensitive until activated.

Still another object of the present invention is to provide underwater systems and methods that generate primarily impulsive shock energy when operated rather than an impulsive response.

Other objects and advantages of the present invention will become more obvious hereinafter in the specification and drawings.

In accordance with the present invention, an underwater shock generation system includes an electrolysis generator that is supplied with an electrolytic liquid. The electrolysis generator is operable to generate an ignitable gas using the electrolytic liquid. A housing stores the ignitable gas and is adapted to be disposed in a water environment. An igniter is provided and is operable to ignite the ignitable gas stored in the housing to generate an explosion in the underwater environment. The housing is shaped to control a direction of propagation of the explosion in the water environment.

BRIEF DESCRIPTION OF THE DRAWINGS

Other objects, features and advantages of the methods and systems of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
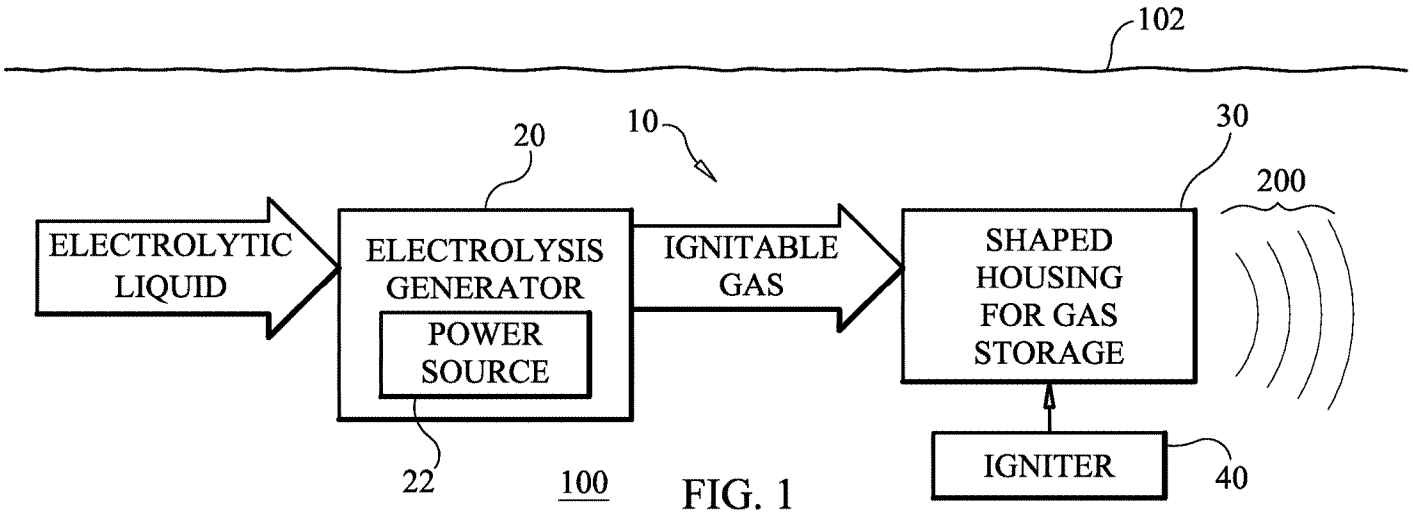
FIG. 1 is a schematic view of an embodiment of a system for underwater shock generation in accordance with various aspects as described herein.

Referring now to the drawings and more particularly to FIG. 1, an embodiment of a system for underwater shock generation is illustrated schematically and is referenced generally by numeral 10. For purpose of describing the present invention, system 10 is shown disposed in a water environment 100 whose surface is indicated by numeral 102. In some embodiments and as will be described further below, water environment 100 may be a seawater environment comprising salt water. System 10 may be a stationary system deployed in water environment 100 or a mobile/maneuverable system moving through water environment 100 without departing form the scope of the present invention. The systems and methods described herein may be used in a variety of underwater applications employing acoustic or shock signals, e.g., natural resource exploration, harbor and/or shipping lane security, etc.

In general, system 10 includes an electrolysis generator 20 for generating an ignitable gas using an electrolytic liquid, a shaped housing 30 for storing the ignitable gas, and an igniter 40 coupled to shaped housing 30 for providing energy to the stored ignitable gas to bring about detonation of the stored ignitable gas. In turn, the detonation of the stored ignitable gas generates an explosion whose impulsive shock energy 200 is directionally propagated into water environment 100 in accordance with the design of shaped housing 30. Impulsive shock energy 200 may include acoustic shock components as well as large kinetic energy components.

Electrolysis generator 20 is supplied with an electrolytic liquid. The constituents of the electrolytic liquid are such that an ignitable gas is generated when the electrolytic liquid is passed through an activated electrolysis generator 20. In some embodiments, the electrolytic liquid and electrolysis generator 20 may be configured to yield oxyhydrogen gas as the ignitable gas. In some embodiments, the electrolytic liquid and electrolysis generator 20 are configured to yield hydrogen, oxygen, and an oxidizing agent (e.g., chlorine gas). In all embodiments, activation of electrolysis generator 20 occurs when an electric current is supplied to the generator's electrodes (not shown) as would be understood in the art. Accordingly, electrolysis generator 20 may be coupled to a power source 22 for generating the requisite electric current of activation. Power source 22 may be integrated with electrolysis generator 20 (as shown) or separate from electrolysis generator 20 without departing from the scope of the present invention. While the particular configuration of electrolysis generator 20 is not a limitation of the present invention, some exemplary embodiments of its electrode arrangements will be shown and described later herein.

In general, the electrolytic liquid supplied to electrolysis generator 20 may be a liquid constitution inclusive of some amount of dissolved solids. When the electrolytic liquid is passed through an activated electrolysis generator 20, a chemical decomposition of the liquid takes place to yield constituents of an ignitable gas such as oxyhydrogen gas. The constitution of the electrolytic liquid may include pure seawater (i.e., salt water), seawater mixed with one or more additives to adjust the molarity of the electrolytic liquid for a particular system or application, or freshwater mixed with suitable electrolyte(s) to provide the required molarity for a particular system or application.

In some embodiments, pure seawater (e.g., obtained from a locale where system 10 is deployed) may contain the proper balance of electrolytes (or proper molarity) needed for electrolysis generator 20 to produce the ignitable gas for storage at shaped housing 30. However, since seawater constituents vary all over the world, the balance of electrolytes (or seawater molarity) changes with locale. For example, while the salt content of a locale's seawater may be sufficient, the seawater may not be properly balanced for production of the desired ignitable gas. In such cases, it may be necessary to mix freshwater with the local seawater to achieve a proper electrolyte balance. In some embodiments, local seawater may need to have its dissolved solids increased by mixing the seawater with one or more salts. Such salts may include, but are not limited to, magnesium salts, potassium salts, simple salts (e.g., sodium chloride), acidic salts (e.g., sodium carbonate, ammonium chloride), basic salts (e.g., (sodium acetate, potassium cyanide, zinc chloride hydroxide), neutral salts (e.g., potassium chlorate, calcium phosphate, sodium nitrate), double salts (e.g., potassium cerium fluoride, Mohr's salt), complex salts (e.g., tetra amino cupric sulfate, hexamine chromium (Ill) chloride), and mixed salts (e.g., bleaching powder, sodium potassium sulfate).

In some embodiments, the electrolytic liquid may be prepared without the use of any seawater. For example, a mixture of freshwater with one or more of the above-listed salts may be used to create the electrolytic liquid. Regardless of its composition, the electrolytic liquid (e.g., pure seawater, a seawater mixture, a freshwater mixture, etc.) may be prepared in advance of system deployment or admitted/blended in-situ just prior to use of the system without departing from the scope of the present invention. By facilitating the admission/blending of the electrolytic liquid just prior to system detonation, the present invention will be completely inert for safe handling and transportation. Further, a deployed system will remain inert even if it is abandoned in air or water environments thereby preventing the system from becoming a long-term and unseen hazard for those who encounter it unexpectedly.

Since hydrogen gas is an important constituent to be separated from the electrolytic liquid, a simple molar gas analysis may be performed to determine the volume of electrolytic liquid needed for an application. By way of example, the following analysis may be used to determine the amount of pure seawater required to generate 5 liters (or 0.005 cubic meters ($m^3$)) of hydrogen gas.

Utilizing the ideal gas law principle $$PV=nRT$$

where the pressure is assumed to be one atmosphere and the temperature is assumed to be 25° C., $$n=\left(\frac{101325\ \text{Pa}*0.005\ \text{m}^3}{8.31446261815324\ \frac{\text{Pa}*\text{m}^3}{\text{K}*\text{mol}}*298.15\ \text{K}}\right)$$

indicates that the number of moles of hydrogen needed is n=0.204 mol

For a molar concentration of pure water (or freshwater) in seawater of $$53.6\ \frac{\text{mol}}{\text{kg}}$$

the molar mass of the hydrogen is 2 g/mol, while the molar mass of oxygen is 16 g/mol. Thus, the hydrogen makes up only 11.11% of the water's weight. Accordingly, the concentration of hydrogen in the seawater is then given by $$5.96\ \frac{\text{mol}}{\text{kg}}$$

Dividing the amount of hydrogen needed by the concentration of hydrogen in seawater indicates that the amount (by weight) of seawater needed to generate 5 liters of hydrogen gas is 0.034 kilograms or 34 grams. The weight of the seawater is readily converted to a volume for a particular system construction as would be well understood in the art. Similar analyses may be performed for oxygen as well as any potential oxidizing agent (e.g., chlorine gas).

Design of electrolytic generator 20 is based on the presumption and/or knowledge of dissolved solids in the electrolytic liquid. With the passage of an electric current through the electrodes of electrolysis generator 20, some form of electrolysis will be generated over time as a function of total power provided to electrolysis generator 20, electrical properties of the electrolysis generator's electrodes, and the dissolved solids/salts in the electrolytic liquid. The power source 22 may generate the needed electric current from either battery(ies), a fixed power grid, a regenerative power source, etc., and is not a limitation of the present invention. To manage power expectations, it may be possible to use estimates of seawater dissolved solids to plan for power requirements in a system as well as optimal selection of electrodes for electrolysis generator 20.

Igniter 40 may be any type of spark ignition device/system capable of generation of an appropriate temperature for detonation of the system's ignitable gas. Such igniters may include one or more of spark plug(s), ignition coil(s), electronic circuit(s), etc. The configuration of igniter 40 may vary without departing from the scope of the present invention. In some embodiments, igniter 40 may be a single-use device. However, it is to be understood that igniter 40 may also be configured for repeated uses for systems designed to be recharged with the ignitable gas between uses.

Figure 2:
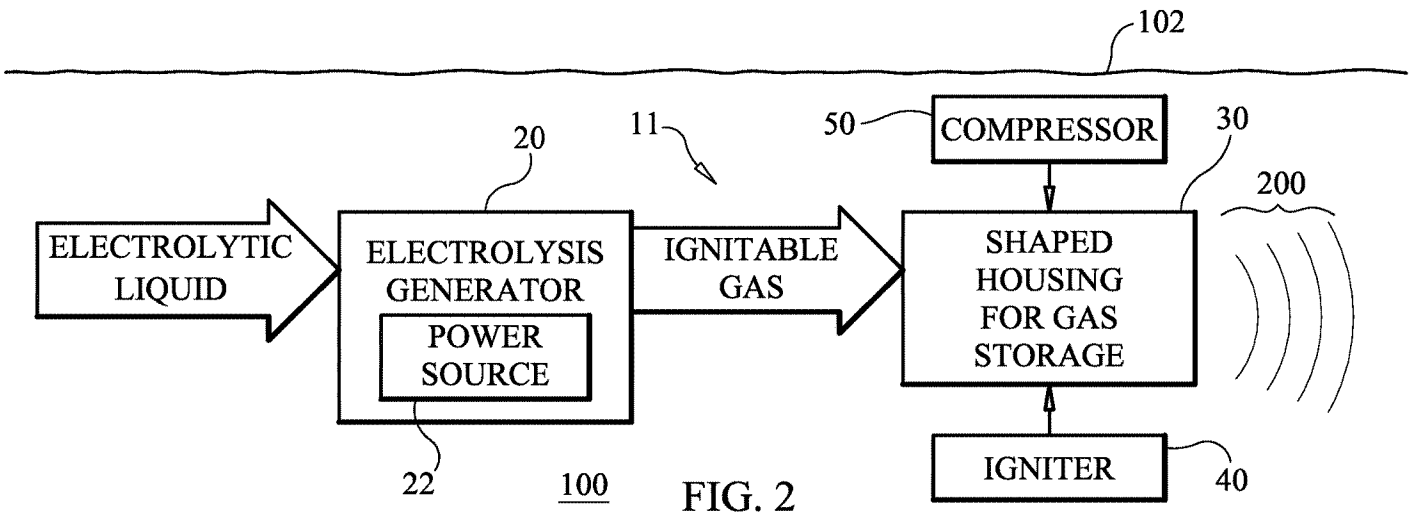
FIG. 2 is a schematic view of another embodiment of a system for underwater shock generation that includes a gas compressor in accordance with various aspects as described herein.

In some embodiments, it may be necessary to control (e.g., increase) the pressure of the ignitable gas stored in the shaped housing 30 as an aspect of preparing the stored ignitable gas for detonation and explosion. Accordingly, FIG. 2 illustrates another system 11 of the present invention in which a compressor 50 is coupled to shaped housing 30 for purpose of, for example, increasing the pressure of the stored ignitable gas. Sensors (not shown) may be provided in shaped housing 30 for feedback control of compressor 50. The inclusion of compressor 50 may also be included/used to contribute to overall system safety in that detonation and explosion activities may not ever be possible unless/until compressor 50 is activated.

Figure 3:
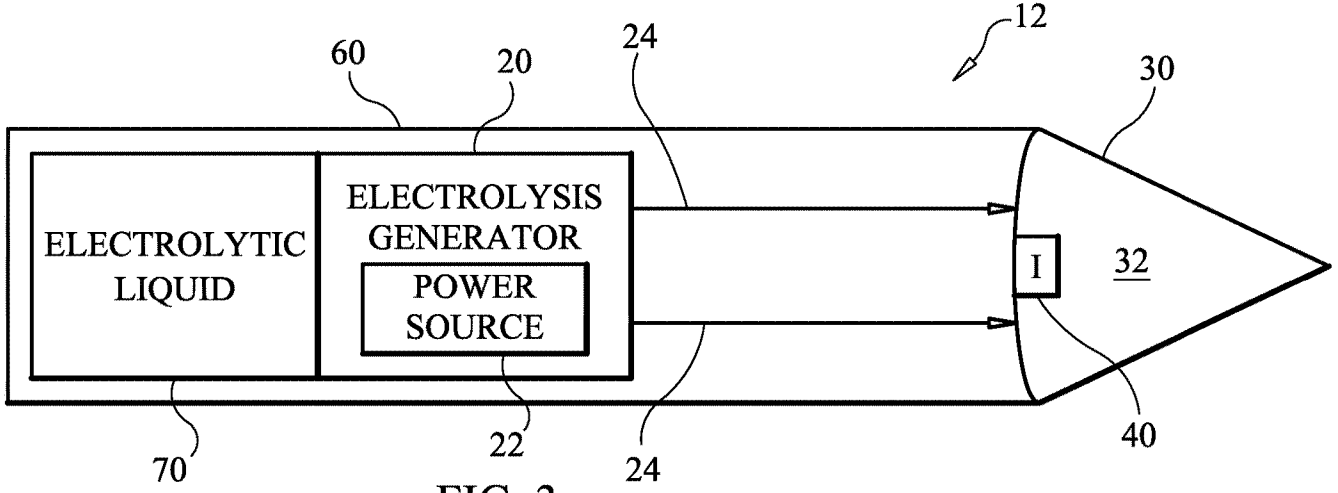
FIG. 3 is a schematic view of another embodiment of a system for underwater shock generation that is self-contained in accordance with various aspects as described herein.

In some embodiments, the system of the present invention may be a self-contained system as illustrated in FIG. 3 and referenced generally by numeral 12. System 12 includes an outer housing 60 that supports a store 70 of the above-described electrolytic liquid, electrolysis generator 20, and shaped housing 30 defining a sealed chamber 32 at, for example, one end of outer housing 60. In general, the walls of shaped housing 30 are shaped to control the direction of propagation of the impulsive shock energy generated by the detonated/exploded ignitable gas as explained above. In some embodiments, shaped housing 30 may be conical to control the direction of propagation of the impulsive energy. However, it is to be understood that the particular shape of shaped housing 30 (and, therefore, sealed chamber 32) is not a limitation of the present invention.

Electrolysis generator 20 and sealed chamber 32 are coupled to one another to support the one-way transfer of the ignitable gas (referenced by arrows 24) into sealed chamber 32. The igniter ("I") 40 may be mounted in sealed chamber 32 at a location designed to initiate detonation/explosion of the ignitable gas and propagation thereof in accordance with application requirements. In some embodiments, a portion of shaped housing 30 may be integrated with a portion of housing 60 (as shown) to facilitate release of the impulsive shock energy when the ignitable gas is detonated/exploded. System 12 may be configured for stationary placement in water environment 100.

Figure 4:
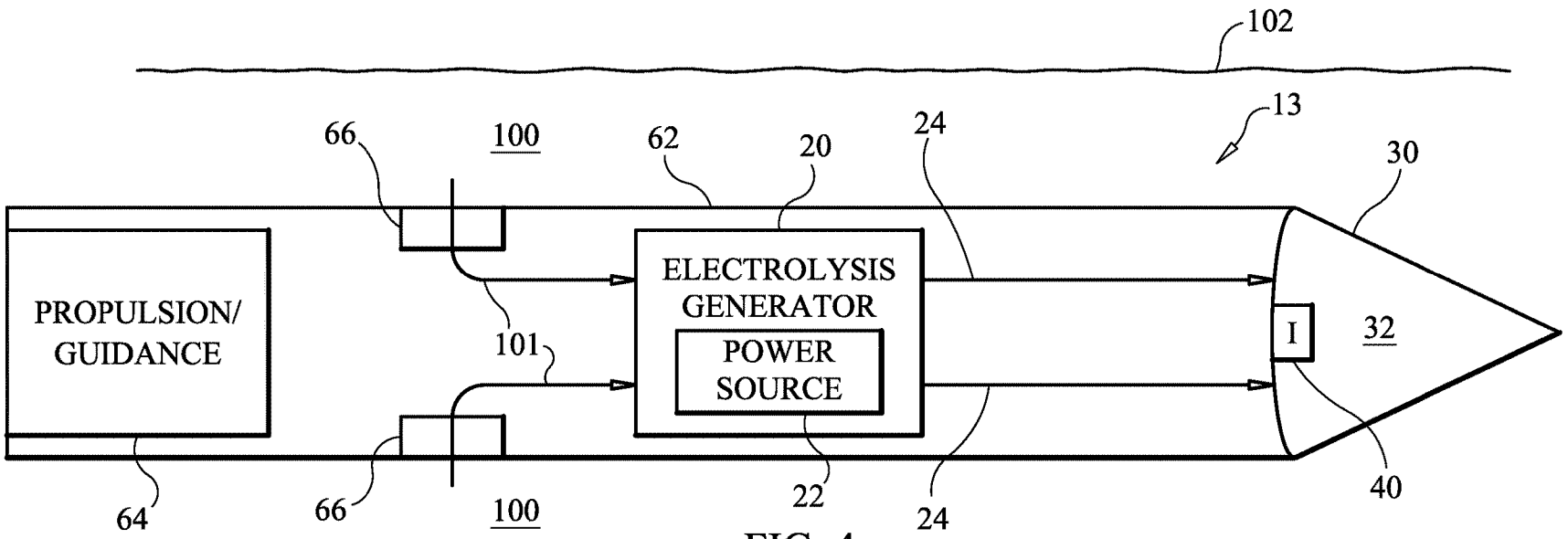
FIG. 4 is a schematic view of another embodiment of a system for underwater shock generation incorporated into an underwater vehicle in accordance with various aspects as described herein.

In some embodiments, a system of the present invention may be configured for the controlled movement/maneuverability in a water environment. For example, FIG. 4 illustrates an underwater shock generation system 13 having an outer housing 62 configured as part of an unmanned underwater vehicle (UUV) where housing 62 may be tubular. Mounted in housing 62 is a propulsion/guidance system 64 to propel and maneuver system 13 during its mission. Housing 62 may be configured with one or more ports/valves 66 to control admission of water 101 (e.g., seawater) from the surrounding water environment 100 where water 101 is supplied when needed to electrolysis generator 20.

Figure 5:
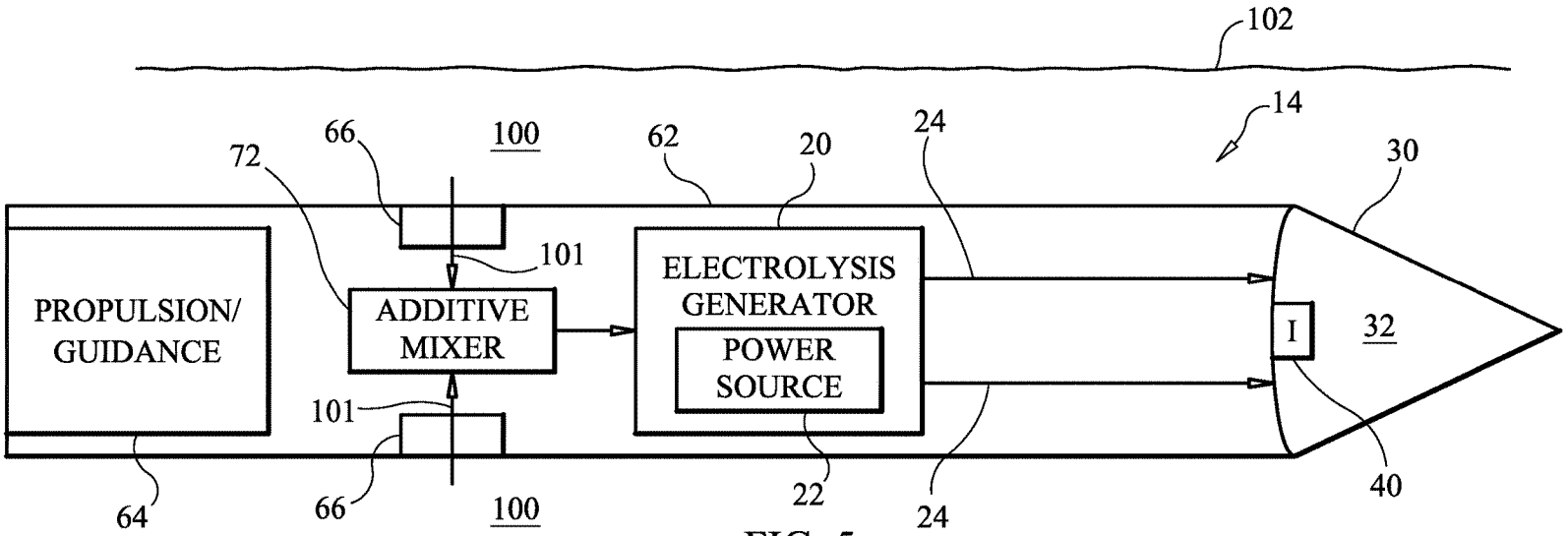
FIG. 5 is a schematic view of another embodiment of a system for underwater shock generation incorporated into an underwater vehicle and including molarity adjustment of the electrolytic liquid in accordance with various aspects as described herein.

In some embodiments, a stationary or maneuverable system in accordance with the present invention may be configured to mix one or more additives with stored water (e.g., seawater or freshwater) or locally-admitted seawater to produce the desired electrolytic liquid that is to be supplied to the system's electrolysis generator. Such mixing may be configured to take place when the system is to be made operational. For example, an underwater shock generation system 14 illustrated in FIG. 5 is a modification of the above-described maneuverable system 13. More specifically, an additive mixer 72 may be provided for adding/mixing one or more additives (e.g., one or more salts, freshwater, etc.) to admitted seawater 101 prior to the resulting electrolytic liquid mixture being supplied to electrolysis generator 20.

Figure 6:
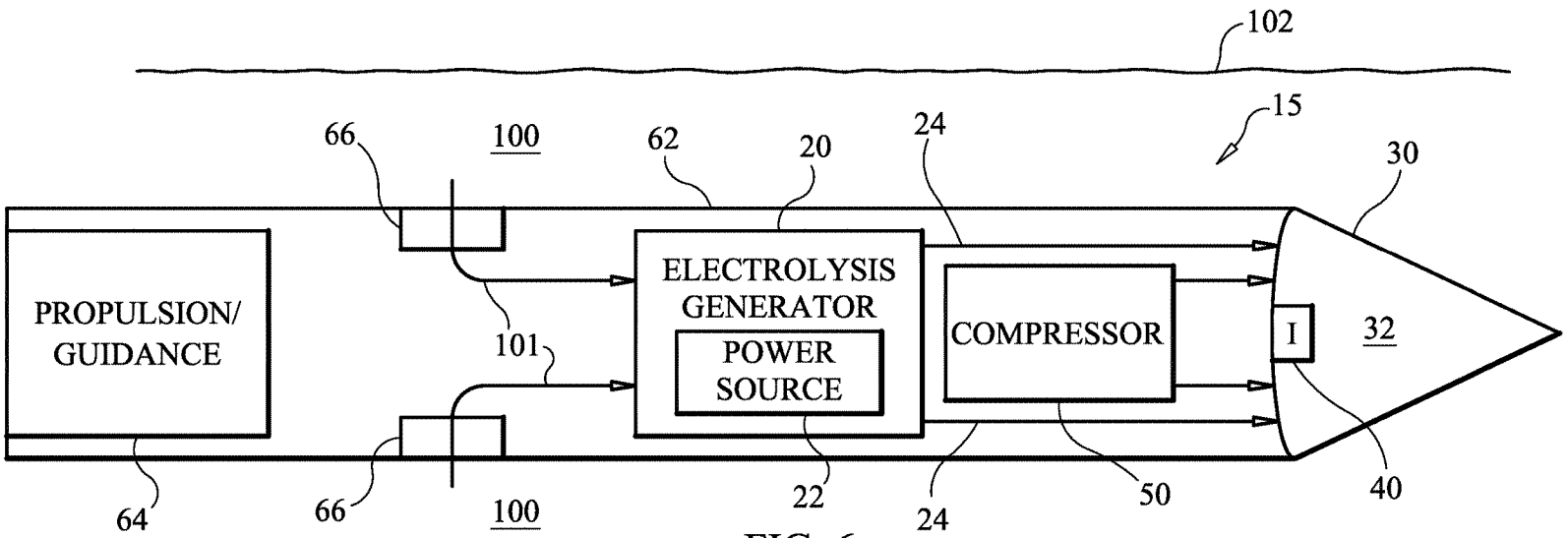
FIG. 6 is a schematic view of another embodiment of a system for underwater shock generation incorporated into an underwater vehicle and including a gas compressor in accordance with various aspects as described herein.

In some embodiments, one of the above-described stationary or maneuverable systems may incorporate a compressor to control the pressure of the ignitable gas stored in the system's shaped housing. For example and as illustrated in FIG. 6, a maneuverable underwater shock generation system 15 includes a compressor 50 for pressure control of the ignitable gas stored in shaped housing 30. It is to be understood that the pressure control feature may be included with any of the embodiments described herein.

Figure 7:
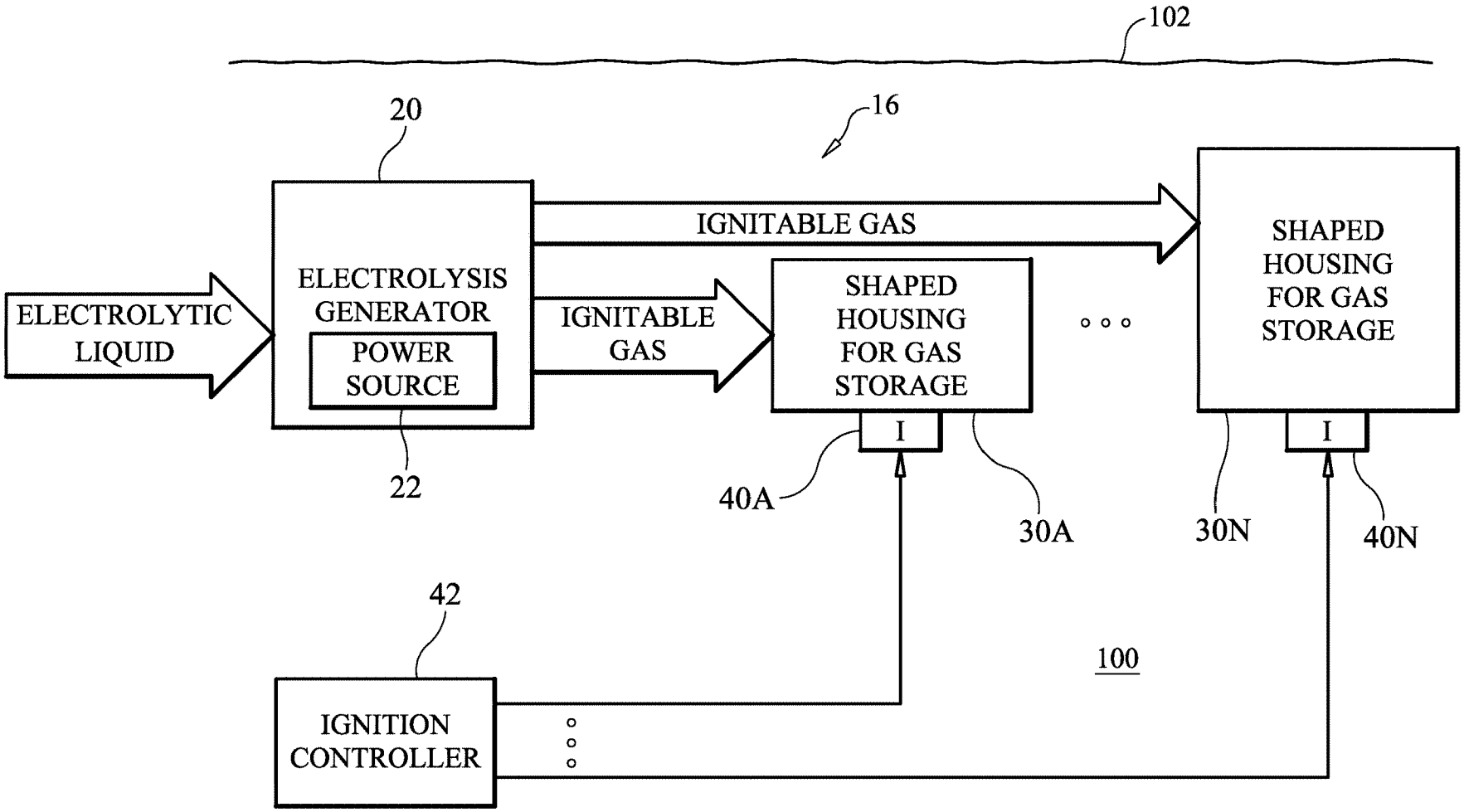
FIG. 7 is a schematic view of an embodiment of a system for underwater shock generation using an array of shaped housings in accordance with various aspects as described herein.

In some embodiments, an underwater shock generation system in accordance with the principles described herein may include multiple shaped housings arrayed in a region of a water environment. For example and as illustrated in FIG. 7, an underwater shock generation system 16 includes a set of shaped housings 30A-30N that may be positioned at predetermined locations of a water environment 100. A single electrolysis generator 20 may be used to supply all of the shaped housings with their ignitable gas. An ignition controller 42 may be used to provide the respective shaped housings' igniters 40A-40N with a control signal to control detonation/explosion of the stored ignitable gas as described above. Such control signals may be supplied simultaneously, in a prescribed order, a random order, selectively, etc., without departing from the scope of the present invention.

Figure 8:
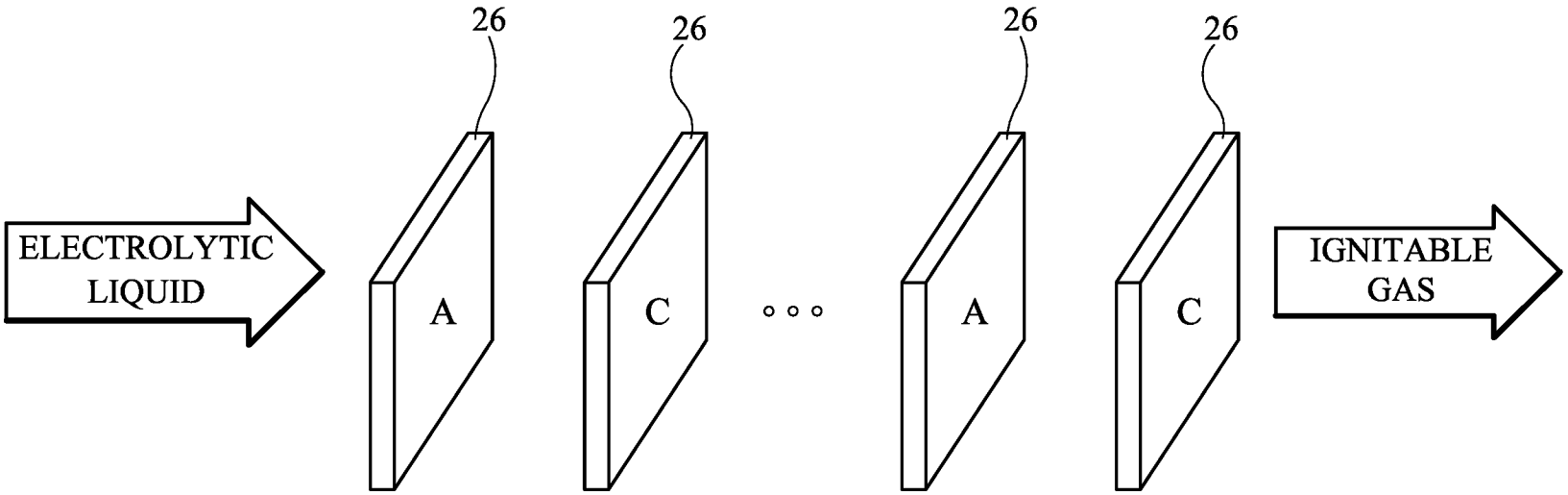
FIG. 8 is a schematic view of an embodiment of an electrode arrangement for an electrolysis generator in accordance with various aspects as described herein.
Figure 9:
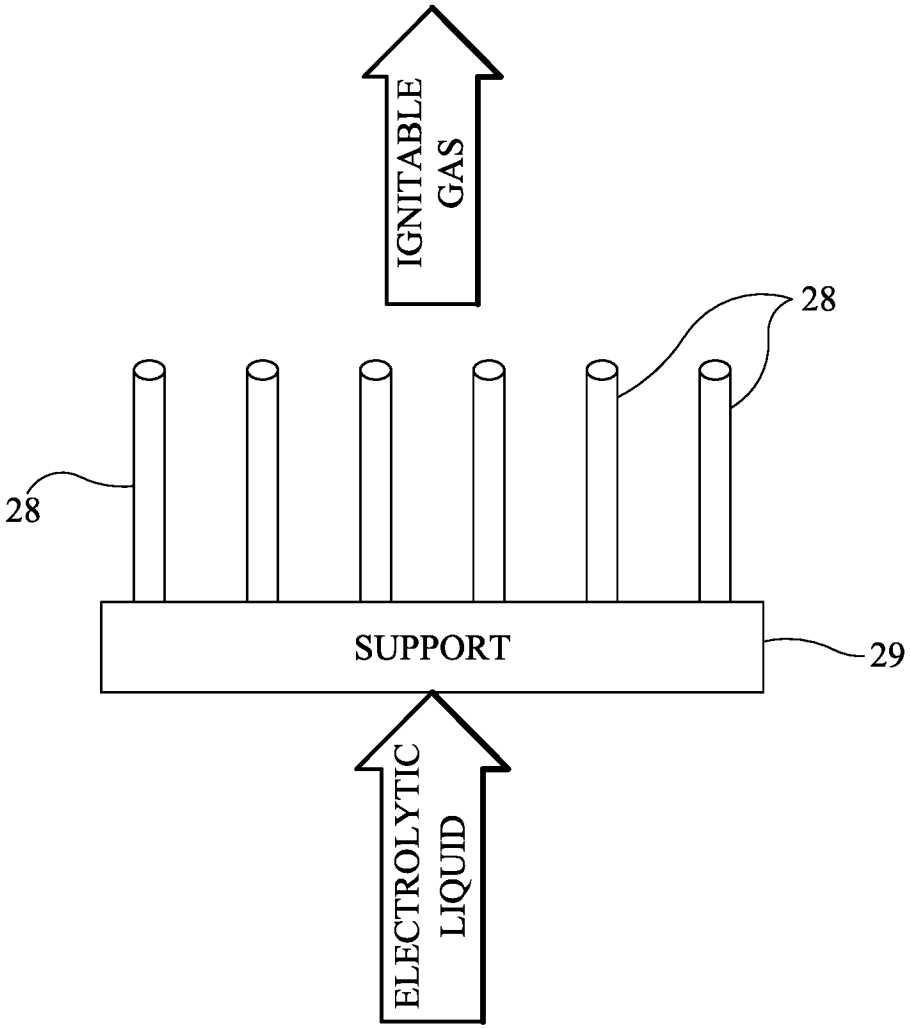
FIG. 9 is a schematic view of another embodiment of an electrode arrangement for an electrolysis generator in accordance with various aspects as described herein.

As mentioned above, an electrolysis generator in accordance with the present invention may utilize a variety of electrode configurations. By way of non-limiting examples, two electrode arrangements are illustrated schematically in FIGS. 8-9. In FIG. 8, the above-described electrolytic liquid is flowed over, past, and between an arrangement of alternating and spaced-apart anode ("A") and cathode ("C") plates 26 that, when activated/energized, will generate the ignitable gas. In FIG. 9, one or more rows (only one is illustrated) of cylindrical electrode rods 28 (e.g., graphite or carbon-fiber rods wrapped in copper foil) are mounted in a support 29. All rods may be connected to the same power supply (not shown) for activation. Support 29 may be configured to allow the electrolytic liquid to flow between activated rods 28 to generate the ignitable gas.

Any of the above-described stationary or maneuverable underwater shock systems utilizing local seawater may be operated in accordance with the following procedure. Prior to use, seawater from the local water environment is admitted into the system and is directed to the system's electrolysis generator. If needed, additives may be mixed with the admitted seawater prior to submission to the electrolysis generator. The electrolysis generator is activated/operated to generate an ignitable gas (e.g., oxyhydrogen gas) as described above. The ignitable gas is stored in the system's shaped housing. At time of use, the system's igniter is activated to detonate the stored ignitable gas to initiate the explosion that is directed by the shaped housing into the water environment.

The advantages of the present invention are numerous. An underwater shock generation system remains inert and safe throughout its manufacture, storage, handling, transportation, and pre-use deployment life. The system may be configured in a variety of ways (e.g., stationary, maneuverable, part of an arrayed system, etc.) to satisfy application requirements. The system may be configured for stored and/or in-situ preparation of the electrolytic liquid thereby further assuring the system's safety.

Although the methods and systems of the present invention have been described relative to specific embodiments thereof, there are numerous variations and modifications that will be readily apparent to those skilled in the art in light of the above teachings. It is therefore to be understood that, within the scope of the appended claims, the methods and systems may be practiced other than as specifically described.

What is claimed as new and desired to be secured by Letters Patent of the United States is:

1. A system, comprising:

an electrolysis generator adapted to be supplied with an electrolytic liquid and operable to generate an ignitable gas using the electrolytic liquid;

a housing storing the ignitable gas, said housing adapted to be disposed in a water environment;

an igniter operable to ignite the ignitable gas stored in said housing to generate an explosion in the water environment; and said housing shaped to control a direction of propagation of the explosion in the water environment.

2. The system of claim 1, wherein the electrolytic liquid is selected from the group consisting of seawater, seawater mixed with at least one additive selected from the group consisting of a salt and freshwater, and freshwater mixed with at least one electrolyte.

3. The system of claim 2, wherein said at least one electrolyte comprises a salt.

4. The system of claim 1, wherein said housing includes a conical portion storing the ignitable gas.

5. The system of claim 1, further comprising a compressor operable to increase pressure of the ignitable gas stored in said housing.

6. The system of claim 1, wherein the ignitable gas comprises oxyhydrogen gas.

7. A system, comprising:

a housing adapted to be disposed in a seawater environment;

an electrolysis generator mounted in said housing and adapted to receive seawater from the seawater environment, said electrolysis generator being operable to generate an ignitable gas using the seawater;

a sealed chamber within said housing and coupled to said electrolysis generator wherein the ignitable gas is stored in said sealed chamber; and an igniter disposed in said sealed chamber and operable to ignite the ignitable gas to generate an explosion;

wherein said sealed chamber has walls shaped to control a direction of propagation of the explosion through said housing and into the seawater environment.

8. The system of claim 7, wherein said housing is tubular.

9. The system of claim 7, further comprising at least one additive for inclusion with the seawater received by said electrolysis generator, said at least one additive selected from the group consisting of a salt and freshwater.

10. The system of claim 7, wherein said sealed chamber is conical.

11. The system of claim 7, further comprising a compressor disposed in said housing and operable to increase pressure of the ignitable gas in said sealed chamber.

12. The system of claim 7, wherein the ignitable gas comprises oxyhydrogen gas.

13. A method, comprising:

by an underwater shock generator having a housing adapted to be disposed in a seawater environment, an electrolysis generator mounted in the housing, a sealed chamber disposed in the housing and coupled to the electrolysis generator, and an igniter disposed in the sealed chamber, admitting seawater from the seawater environment into the housing;

directing the seawater admitted from the seawater environment into the electrolysis generator wherein the electrolysis generator operates to generate an ignitable gas using the seawater;

storing the ignitable gas in the sealed chamber; and activating the igniter to ignite the ignitable gas to generate an explosion, wherein the sealed chamber has walls shaped to control a direction of propagation of the explosion through the housing and into the seawater environment.

14. The method of claim 13, wherein the housing comprises an underwater vehicle, the method further comprising maneuvering the underwater vehicle in the seawater environment.

15. The method of claim 13, further comprising:

mixing at least one additive with the seawater prior to the step of directing, wherein the at least one additive is selected from the group consisting of a salt and freshwater.

16. The method of claim 13, wherein the sealed chamber is conical.

17. The method of claim 13, further comprising:

increasing, by a compressor coupled to the sealed chamber, pressure of the ignitable gas in the sealed chamber.

18. The method of claim 13, wherein the ignitable gas comprises oxyhydrogen gas.

* * * * *